United States Patent [19]

Assmann et al.

[11] 4,343,421

[45] Aug. 10, 1982

[54] TENSIONLESS FABRIC FEEDING APPARATUS

[75] Inventors: John J. Assmann; James L. Knox; Martin J. Kueny, all of Philadelphia; James W. Smith, Havertown, all of Pa.

[73] Assignee: Interco Incorporated, St. Louis, Mo.

[21] Appl. No.: 183,289

[22] Filed: Sep. 2, 1980

[51] Int. Cl.[3] ..... B65H 17/42

[52] U.S. Cl. ..... 226/113

[58] Field of Search ..... 226/113–119; 242/75.52, 67.2; 26/54

[56] References Cited

U.S. PATENT DOCUMENTS 2,295,327 9/1942 Bendz ..... 242/75.52

3,755,861 9/1973 Castro et al. ..... 26/54

*Primary Examiner*—Leonard D. Christian

*Attorney, Agent, or Firm*—Donald J. Fitzpatrick

[57] ABSTRACT

An apparatus for feeding fabric in a tensionless and distortion free manner to a fabric treating device. The fabric feeding apparatus comprises a loop forming station, a feeding station and an operator-collector station. The loop forming station continuously forms a tensionless loop of fabric by a pair of driven puller rolls, caused to activate by a signal from a photoelectric combination. The loop of fabric is sequentially fed to a feeding station by the controlled movement of a pin clamping assembly. The movement of the pin clamping assembly causes the photoelectric combination to send a signal activating the puller rolls to reform a tensionless loop. This sequence of pin clamping assembly movement and loop formation causes fabric to be continuously fed in a tensionless and distortion free manner to a fabric treating device.

4 Claims, 3 Drawing Figures

TENSIONLESS FABRIC FEEDING APPARATUS

BACKGROUND OF THE INVENTION

1. Field of the Invention

The present invention relates to an apparatus for feeding fabric to a fabric treating device and, more particularly, to an apparatus for feeding fabric in a tensionless and distortion free manner to a cutting, sewing or seaming apparatus.

2. Description of the Prior Art

In order to reduce the manufacturing costs in the construction and assembly of shirts, pants, suits, dresses and the like it is necessary and desirable to replace manual assembly steps in a work cycle with faster and efficient machine assembly steps. A typical assembly in the manufacture of a garment involves that of making cuffs. In the manual assembly of cuffs, lining fabric is spread out on a lay-out table, blocked to a preliminary size and die cut, in a like manner these three manual steps are repeated for cuff fabric. A bundle of each type of fabric is packaged in a specific quantity and sent to a sewing room. In this room a sewing machine operator manually sews cuffs by taking a piece of lining fabric and a piece of cuff fabric and hand sewing the two pieces together. It is estimated that a skilled operator can hand sew approximately 8.5 dozen per hour.

Attempts have been made to assemble and sew cuffs by mechanically feeding lining fabric and cuff fabric to a sewing machine. In this mechanical process lining and cuff fabric are fed to a sewing machine from rolls. Thus laying out fabric, blocking to a preliminary size and die cutting is eliminated. Although feeding fabric from a roll eliminates the time consuming layout, blocking and die cutting other problems have been experienced using machine assembly techniques. One of the problems concerns feeding fabric in a uniform and distortion free manner. In order to produce cuffs of consistent dimensions the fabric must be fed to the sewing machine essentially flat with properly aligned edges. In addition the fabric must not be stretched in any manner either during feeding to the sewing machine or during the sewing step. Thus a critical problem associated with the machine assembly of cuffs is uniform and properly aligned feeding so as to produce cuffs of consistent dimensions. In the construction and later assembly of shirts and blouses, cuffs are sewn on. If the cuffs are not of consistent and uniform dimensions they will not fit properly and must be discarded rather than produce an off-quality product. Production of such a product completely negates whatever cost saving advantages that may be associated with machine assembly techniques.

SUMMARY OF THE INVENTION

The fabric feeding apparatus of this invention continuously feeds fabric in a tensionless and distortion free manner to a fabric treating device. This apparatus comprises a loop forming station, a feeding station and an operator-collector station. The loop forming station continuously forms an unsupported tensionless loop of fabric by a pair of driven puller rolls, that are caused to operate by the reception of a signal from a photoelectric combination. After formation the loop of fabric is sequentially fed into a feeding station by the controlled movement of a pin clamping assembly. This assembly moves lining fabric and cuff fabric in a tensionless and distortion free manner to a pre-determined location whereupon the fabric layers are sewn or stitched together. The pin clamping assembly then moves another segment of lining and cuff fabric into contact with the sewing machine. This movement causes the photoelectric combination at the loop forming station to send a signal to a relay thus activating the puller rolls to reform a tensionless loop. This sequence of pin clamping assembly movement and loop formation causes fabric to be continuously fed in a tensionless and distortion free manner to a fabric treating device.

It is therefore an object of this invention to provide an apparatus for continuously feeding fabric to a fabric treating device.

It is another object of this invention to provide an apparatus for continuously feeding fabric in a tensionless and distortion free manner to a fabric treating device.

A still further object of this invention is to provide a process for feeding fabric in a tensionless and distortion free manner to a fabric treating device.

These and other objects will become apparent from the description of the invention as hereinafter more fully described.

DESCRIPTION OF THE DRAWINGS

The above and other objects, features and advantages of the present invention will become more readily apparent from the following descriptions of an embodiment of the invention in conjunction with the accompanying drawings, wherein.

DETAILED DESCRIPTION OF THE INVENTION

Figure 1:
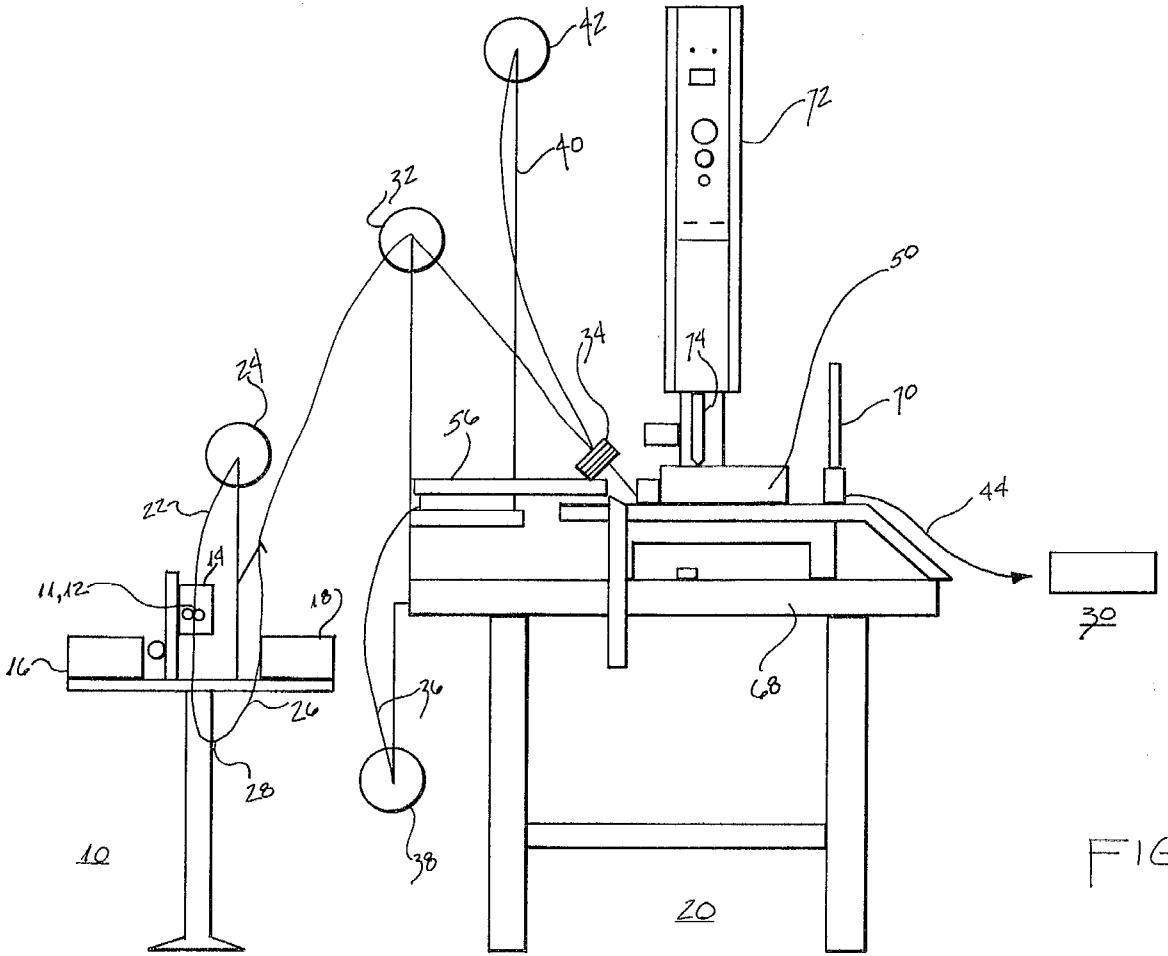
FIG. 1 is a frontal elevational view of the fabric feeding apparatus of this invention.

The tensionless fabric feeding apparatus of this invention comprises a loop forming station 10, a feeding station 20 and an operator-collector station 30.

The loop forming station further comprises a pair of puller rolls 11, 12 which are driven by a variable drive electric motor 14. Positioned on either side of the puller rolls is a photoelectric sender-receiver combination 16, 18. The sender and receiver are aligned so as to enable the establishment of a photoelectric light beam. A roll of fabric 22 is positioned on pay off reel 24 and is caused to pass into a nip formed by the feeder rolls thereby forming an unsupported loop 26 having a lower extent portion 28 between sender-receiver 16, 18. When the lower extent portion is caused to reach the aligned sender-receiver combination continuity is established i.e., formation of a light beam within this photoelectric combination. The establishment of this light beam and its reception generates an electric signal that activates a relay switch 32. A signal is then transmitted to the variable drive motor 14 causing the puller rolls to reform loop 26 by removing a segment of fabric from the roll carried on the pay off reel. The surface of the feeder rolls can be treated and modified to change the frictional force that can be exerted, depending upon the type of fabric that will be processed. Thus the roll surfaces can be rubber coated, knurled or plated as required to process different fabrics.

Unsupported loop 26 is sequentially fed into feeding station 20 by controlled movement of pin clamping assembly 50 as hereinafter more fully described. The sequentially advancing fabric is caused to pass over a guide roll 32 and into a folder element 34. A supply of supporting paper 36 carried on supply roll 38 is payed off and deposited onto the bottom surface of the fabric. This layer of paper acts to support and give rigidity to thin and light weight fabric. A supply of cloth lining 40 carried on supply roll 42 is payed off in a similar manner and deposited onto the upper surface of the fabric thus forming a three layer composite 44. This composite is formed at the exit end of the folder and consists of a layer of folded fabric 22 interposed between a bottom layer 36 of supporting paper and an upper layer of cloth lining 40.

Figure 3:
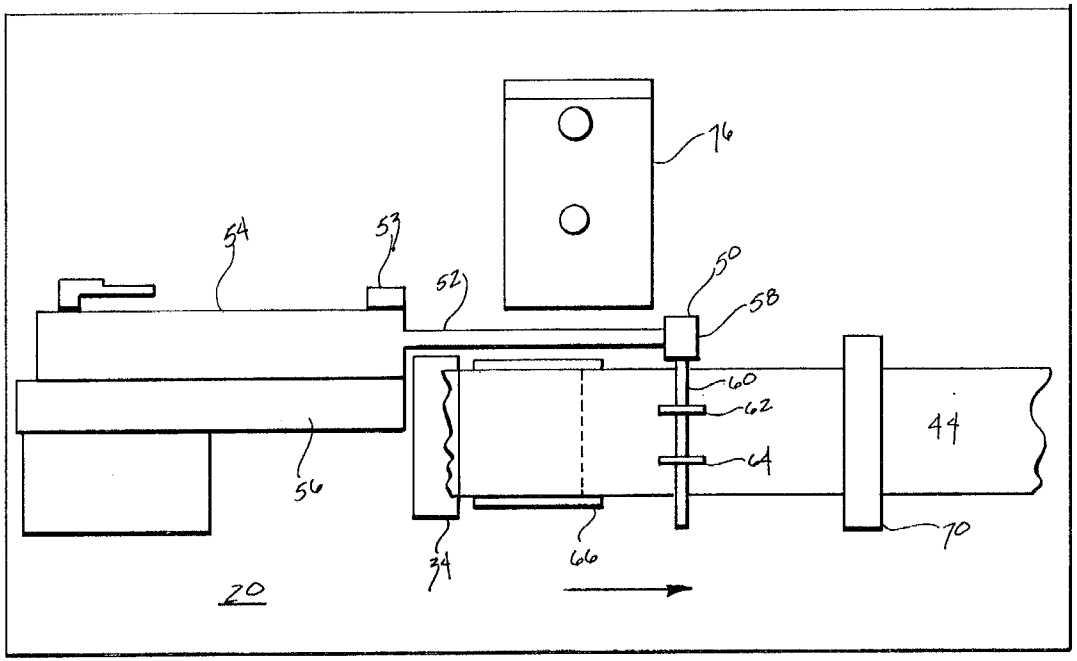
FIG. 3 is a plan view of the feeding station of this invention.
Figure 2:
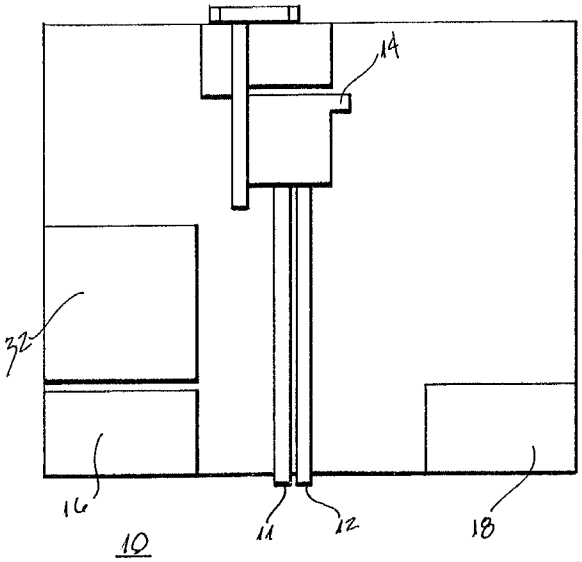
FIG. 2 is a plan view of the loop forming station of this invention.

Attention is directed to FIG. 3 for a more detailed explanation of the operation of the pin clamping assembly 50. This assembly is adapted to move in a longitudinal direction, as shown by the arrow parallel to the movement of composite 44. Assembly 50 is supported and carried by an extendable and retractable shaft 52 which moves within housing 54. Shaft 52 is pneumatically coupled to an air cylinder 56. This assembly further comprises a head portion 58 and a shaft 60 which is essentially perpendicular to shaft 52 and rigidly positioned within a bore of the head portion. Disposed, in an adjustable manner, are moveable, pneumatically activated pinning elements 62 and 64. These elements act to transport composite 44 to a predetermined location on the feeding station prior to a further processing step. The longitudinal travel of the composite is maintained in alignment by a guide channel 66 fastened to the feeding station base member 68. A hold down clamp 70 that is pneumatically coupled to air cylinder 56 and is adapted to function when the pin clamping assembly is fully extended from housing 54. This clamp serves to hold the composite within guide 66 and prevent any lateral movement and also maintain uniformity in fabric dimensions. Thus the fabric is not stretched or distorted in any manner.

Positioned adjacent to the loop forming and feeding stations is an operator-collector station 30. While the actual electrical, pneumatic and mechanical functioning of this station is not shown in detail, it is believed to be well within the capabilities of those skilled in the art to understand how this station operates. Generally speaking an operator is positioned at this station to control and manipulate start and stop switches that serve to activate feeding station 20 thus causing fabric to be processed through the loop forming station 10. A collection surface (not shown) is provided for the cut, sewn, or fused composite 44 to be collected thereon.

FIG. 1 shows a fabric treating device that is well suited to function with the feeding apparatus of this invention. There is shown in this figure an ultrasonic seaming and cutting device 72 of the type shown and described in U.S. Pat. No. 3,852,144 issued to Parry and herein incorporated by reference. This device is fitted with a horn 74 which transmits sonic energy to a work piece such as composite 44 which is fed into a contacting manner with the horn. The ultrasonic seaming and cutting device herein described is by way of illustrative purposes only and not intended to limit the scope of this invention. A sewing machine utilizing a bobbin and needle or electric cutting shears are equally well suited for use in combination with this herein described tensionless fabric feeding apparatus. For example, FIG. 3 shows a schematic representation of a cutting, sewing or seaming device 76 that can be used with this invention.

The operation of the apparatus of this invention can best be understood by reference to the following specific example.

A roll of polyester fabric 22 is positioned on pay off reel 24 and caused to form an unsupported tensionless loop 26 by puller rolls 11, 12 and guide roll 32. An operator at station 30 activates a pneumatic system whereby pin clamping assembly 50 causes a composite fabric 44 to travel longitudinally across feeding station 30. This movement is accomplished by pinning elements 62 and 64 rotating in a downward manner on shaft 60 pinning and holding the composite while at the same time assembly 50 extends from housing 54 until it reaches a predetermined location on the feeding station and stops. When the pin clamping assembly stops hold down clamp 70 is pneumatically activated and firmly holds composite 44 within guide channel 66. The pin assembly simultaneously retracts into housing 54. When head portion 58 reaches the end of the stroke of shaft 52 a micro-switch 53 is activated. This switch is positioned on the housing and is pneumatically coupled to ultrasonic seaming and cutting device 72 and causes this device to act upon composite 44. Simultaneously with this processing function hold down clamp 70 is pneumatically retracted off the fabric and pin clamping assembly advances another segment of fabric into the feeding station. This movement of fabric causes the lower extent 28 of the unsupported loop to reach the sender-receiver combination 16, 18 causing a photoelectric signal to activate the relay switch 32. This signal causes by puller rolls 11, 12 to remove another segment of fabric from roll 22 thus reforming tensionless loop 26. This sequence of pin clamping assembly movement and loop formation causes fabric to be continuously fed in a tensionless and distortion free manner to a cutting, sewing or seaming device. The apparatus herein described when used in combination with an ultrasonic seaming and cutting device is capable of producing approximately 28.5 dozen cuffs per hour. This rate of production is almost 300% greater than the manual assembly of cuffs.

Various modifications of the invention in addition to those shown and described herein will become apparent to those skilled in the art from the foregoing description. Such modifications are intended to fall within the scope of the appended claims.

We claim:

1. An apparatus for feeding fabric in a tensionless and distortion free manner to a fabric treating device comprising:

a station for continuously forming an unsupported tensionless loop of fabric, a feeding station comprising, a pin clamping assembly for sequentially receiving and advancing said fabric to a predetermined location, clamping means coupled to said pin clamping assembly and adapted to hold and maintain alignment of said fabric, thereby preventing any stretch or distortion, drive means coupled to said pin clamping assembly and clamping means; and a collector station.

2. The apparatus of claim 1 wherein said pin clamping assembly further comprises:

a first shaft adapted to move in a longitudinal direction, parallel to the advancement of said fabric;

a head portion carried by said first shaft;

a second shaft positioned within a bore of said head portion and arranged in a perpendicular relationship to said first shaft; and adjustable pinning means positioned on said second shaft and adapted to contact and advance said fabric to a predetermined location.

3. The apparatus of claim 2 wherein said adjustable pinning means further comprises:

a pair of rotatable, elements, adapted to rotate in a downward manner thereby contacting, holding and advancing said fabric.

4. The apparatus of claim 2 further comprising:

a housing for containing said first shaft; and switch means fastened to said housing and adapted to send a signal when contacted by said head portion when said first shaft is retracted into said housing.

* * * * *